US009539811B2

(12) United States Patent
Machida

(10) Patent No.: US 9,539,811 B2
(45) Date of Patent: Jan. 10, 2017

(54) INKJET HEAD

(71) Applicant: KONICA MINOLTA, INC, Tokyo (JP)

(72) Inventor: Yuichi Machida, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/891,571

(22) PCT Filed: May 12, 2014

(86) PCT No.: PCT/JP2014/062561

§ 371 (c)(1),
(2) Date: Nov. 16, 2015

(87) PCT Pub. No.: WO2014/185370

PCT Pub. Date: Nov. 20, 2014

(65) Prior Publication Data

US 2016/0144625 A1 May 26, 2016

(30) Foreign Application Priority Data

May 15, 2013 (JP) ..... 2013-103205

(51) Int. Cl.
*B41J 2/14* (2006.01)

(52) U.S. Cl.
CPC ..... *B41J 2/14233* (2013.01); *B41J 2/14209* (2013.01); *B41J 2/14201* (2013.01);
(Continued)

(58) Field of Classification Search
None
See application file for complete search history.

(56) References Cited

FOREIGN PATENT DOCUMENTS

| | | |
|---|---|---|
| JP | 2002-248775 | 9/2002 |
| JP | 2006-168249 | 6/2006 |

(Continued)

OTHER PUBLICATIONS

Yanada, Atsuo JP2011115972A—Machine Translation, "Ink Jet Head", Jun. 16, 2011, Paragraphs 0018-0027.*

(Continued)

*Primary Examiner* — Lisa M Solomon
(74) *Attorney, Agent, or Firm* — Cozen O'Connor

(57) ABSTRACT

Inkjet head comprising a substrate having pressure chambers, which contain ink, communicate with respective nozzles from which the ink is ejected in a predetermined direction. A spacer substrate is disposed on an opposite side of a diaphragm from the predetermined direction. The diaphragm forms one surface of each of the pressure chambers, which is on an opposite side of the each of the pressure chambers from the predetermined direction. A wiring substrate is disposed on an opposite side of the spacer substrate from the predetermined direction. Actuators are in contact with the diaphragm in a space formed by the spacer substrate between the wiring substrate and the diaphragm, the actuators being electrically connected to respective wires of the wiring substrate. Differences in coefficients of thermal expansion between the pressure-chamber substrate, the diaphragm, the spacer substrate, and the wiring substrate are equal to or less than a predetermined value.

11 Claims, 10 Drawing Sheets

(52) U.S. Cl.
CPC ..... *B41J 2002/14241* (2013.01); *B41J 2002/14459* (2013.01); *B41J 2002/14491* (2013.01); *B41J 2202/18* (2013.01); *B41J 2202/20* (2013.01)

(56) References Cited

FOREIGN PATENT DOCUMENTS

| | | | | |
|---|---|---|---|---|
| JP | 2006168249 | A | * | 6/2006 |
| JP | 4929755 | | | 10/2006 |
| JP | 2006-334975 | | | 12/2006 |
| JP | 2007-83484 | | | 4/2007 |
| JP | 2010-69750 | | | 4/2010 |
| JP | 2011115972 | A | * | 6/2011 |
| JP | 2011218641 | A | * | 11/2011 |
| JP | 2012-61689 | | | 3/2012 |

OTHER PUBLICATIONS

Yoshida, Kojiro JP2011218641A—Machine Translation, "Ink Jet Head", Nov. 4, 2011, Paragraphs 0025, 0027-0032.*
Koda, Tomohiko et al. JP2006168249A—Machine Translation, "Inkjet Head, Method Form Controlling It, and Method of Cleaning It", Jun. 29, 2006, Paragraph 0025.*

* cited by examiner

INKJET HEAD

RELATED APPLICATIONS

This is a U.S. National stage of International application No. PCT/JP2014/062561 filed on May 12, 2014. This patent application claims the priority of Japanese application no. 2013-103205 filed May 15, 2013 the disclosure content of which is hereby incorporated by reference.

TECHNICAL FIELD

The present invention relates to an inkjet head.

BACKGROUND ART

An inkjet head includes multiple nozzles to eject ink, multiple pressure chambers to apply pressures for the ink to be ejected from the nozzles, and flow paths to supply ink to the pressure chambers etc. If these components of the inkjet head are arranged along a plane (e.g. horizontal plane) perpendicular to the ink ejection direction (e.g. vertical direction), the intervals between the nozzles have to be large, making it impossible to increase the density of ejected ink. An inkjet head has been known where pressure chambers are disposed above nozzles and where a common flow path to supply ink to the pressure chambers is disposed further above the pressure chambers to increase the density (see, for example, Patent Literature 1). Such an inkjet head actuates actuators that are externally in contact with the wall surfaces of the pressure chambers and applies pressures to the interiors of the pressure chambers to eject ink from the nozzles.

FIG. 9 is a cross-sectional view of the configuration, around a nozzle, of a conventional inkjet head.

As shown in FIG. 9, an actuator 203 and a wiring substrate 204 are electrically connected to each other through a bump 205 and a solder 206. The actuator 203 is externally in contact with each pressure chamber 201 through a diaphragm 202 disposed on the upper surface of the pressure chamber 201. The wiring substrate 204 is made of silicon and is disposed above the actuator 203. The bump 205 is formed on an electrode 203*a* of the actuator 203. The solder 206 is formed on the wiring substrate 204 side. In order to form a space for the bump 205 and the solder 206 between the wiring substrate 204 and the actuator 203, a photopolymer spacer substrate 207 is disposed between a pressure-chamber substrate 201*a*, which forms the pressure chamber 201, and the wiring substrate 204.

PRIOR ART LITERATURES

Patent Literature

Patent Literature 1: Japanese Patent No. 4929755

DISCLOSURE OF INVENTION

Problems to be Solved by the Invention

Ink, the viscosity of which significantly varies depending on temperature, can be used for such an inkjet head as described above. When such ink is to be ejected, the ink in the inkjet head before being ejected is heated, and the inkjet head is also heated by the heat of the ink.

Since the areas around the nozzles of the inkjet head are formed of a stack of layers as described above, the heat causes warps in the inkjet head due to the differences in coefficients of thermal expansion of the substrates constituting the individual layers. Such warps change the angles at which ink is ejected from the nozzles and have bad effects on image quality. In addition, the warps may cause separation between the substrates depending on the degrees of the warps, leading to problems of ink leakages and bad electrical connections.

The warps of the substrates might also be caused by the heat applied at the time of manufacture of the inkjet head, e.g., at the time of formation of the bumps 205.

An object of the present invention is to provide an inkjet head that can prevent the occurrences of problems which would be caused by warps of the substrates.

Means for Solving Problems

An inkjet head according to an embodiment of the invention as in unit 1 includes: a pressure-chamber substrate in which pressure chambers to contain ink are formed, the pressure chambers communicating with respective nozzles from which the ink is ejected in a predetermined direction; a spacer substrate disposed on an opposite side of a diaphragm from the predetermined direction, wherein the diaphragm forms one surface of each of the pressure chambers, and the one surface is on an opposite side of the each of the pressure chambers from the predetermined direction; a wiring substrate disposed on an opposite side of the spacer substrate from the predetermined direction; and actuators in contact with the diaphragm in a space formed by the spacer substrate between the wiring substrate and the diaphragm, the actuators being electrically connected to respective wires of the wiring substrate, wherein differences in coefficients of thermal expansion between the pressure-chamber substrate, the diaphragm, the spacer substrate, and the wiring substrate are equal to or less than a predetermined value.

An embodiment of the invention as in unit 2 is the inkjet head according to unit 1, wherein the pressure-chamber substrate, the diaphragm, the spacer substrate, and the wiring substrate are each made of material having a thermal conductivity of equal to or more than 10 [$W \cdot m^{-1} \cdot K^{-1}$].

An embodiment of the invention as in unit 3 is the inkjet head according to unit 1 or 2, wherein material for the pressure-chamber substrate, the diaphragm, and the wiring substrate is silicon; and material for the spacer substrate is 42 alloy.

An embodiment of the invention as in unit 4 is the inkjet head according to any one of units 1 to 3, wherein the spacer substrate has a thickness of not less than 50 [μm] and not more than 200 [μm].

An embodiment of the invention as in unit 5 is the inkjet head according to any one of units 1 to 4, wherein the spacer substrate includes ink connection paths communicating with the respective pressure chambers; and at least the ink connection paths are surface-treated.

An embodiment of the invention as in unit 6 is the inkjet head according to any one of units 1 to 5, further including a nozzle substrate having the nozzles formed thereon, wherein material for the nozzle substrate is silicon.

An embodiment of the invention as in unit 7 is the inkjet head according to unit 6, wherein the nozzles are formed by dry etching on the nozzle substrate.

Effects of the Invention

The present invention can prevent the occurrences of problems which would be caused by warps of the substrates.

EMBODIMENT TO CARRY OUT THE INVENTION

Figure 1:
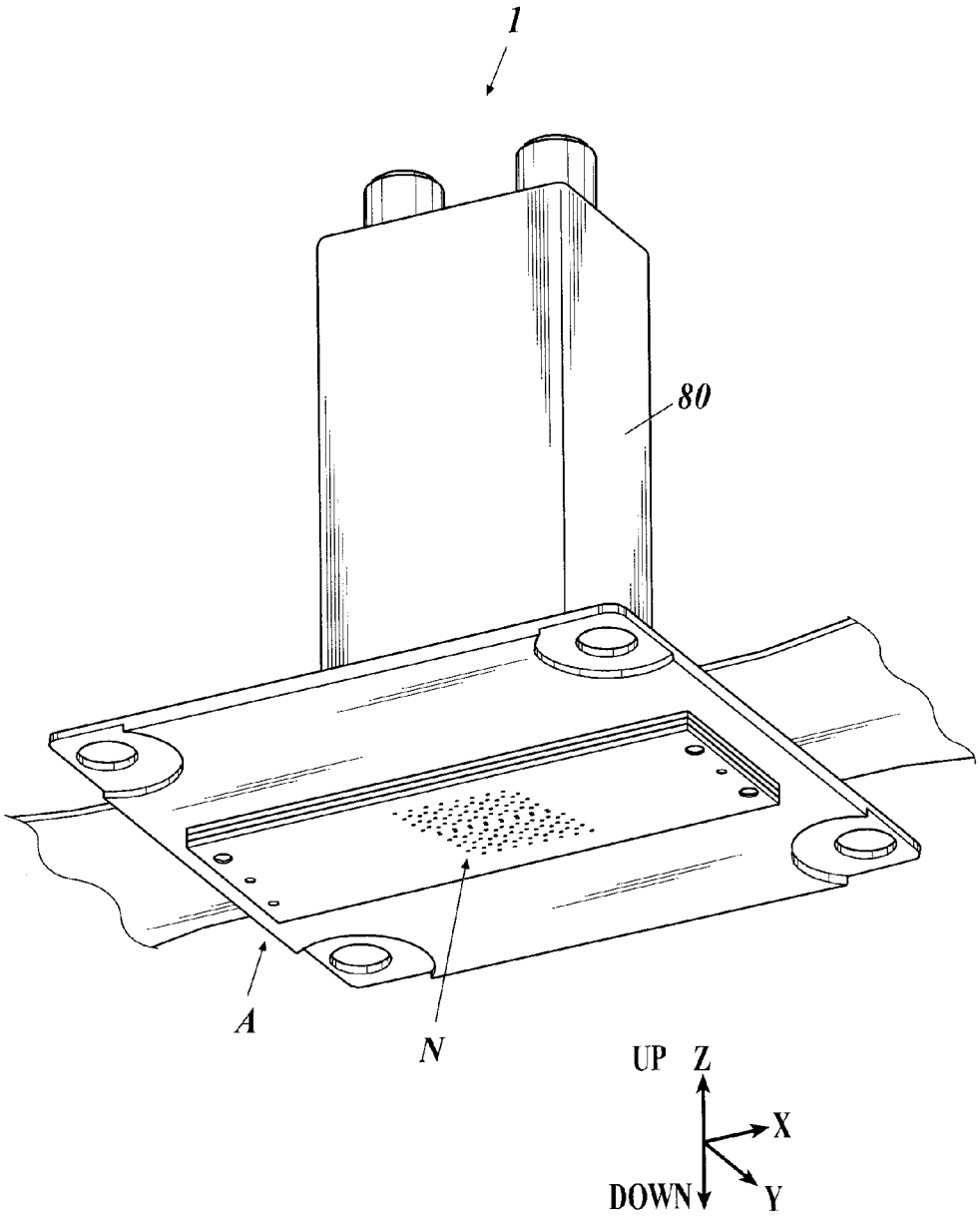
FIG. 1 is a perspective view of an inkjet head according to the present invention.

An embodiment of the present invention will now be described with reference to the drawings. The embodiment described below includes various limitations that are technically preferable to carry out the present invention. The scope of the invention, however, should not be limited to the embodiment described below and the examples shown in the drawings.

FIG. 1 is a perspective view of an inkjet head 1 according to the present invention.

As shown in FIG. 1, the inkjet head 1 has multiple nozzles N arranged along a plane.

In the following description, the plane on which the nozzles N are arranged is referred to as an X-Y plane; the directions along the plane are referred to as X and Y directions, which are perpendicular to each other; and the direction perpendicular to the X-Y plane is referred to as a Z direction.

Figure 2:
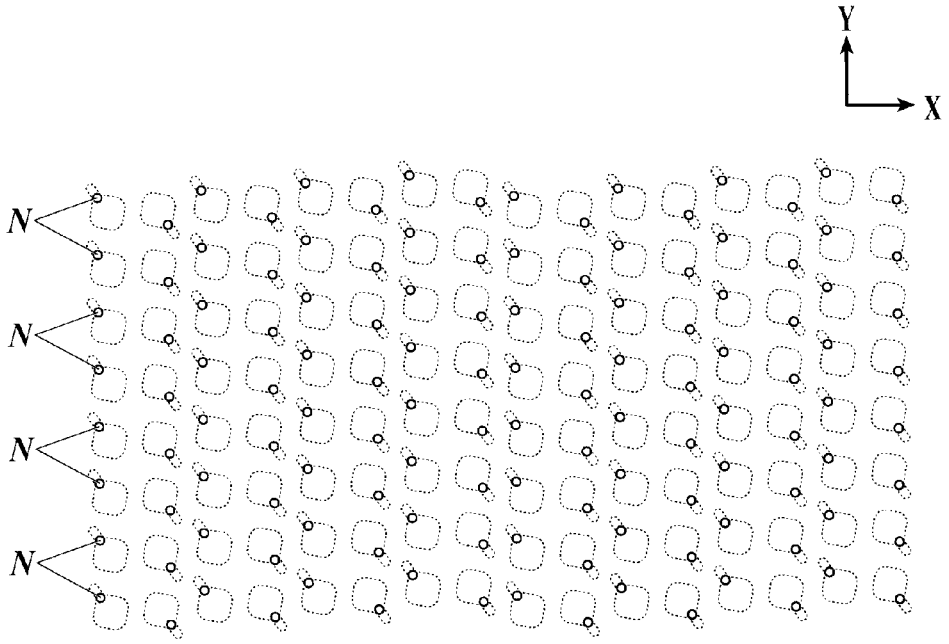
FIG. 2 is a view showing an example arrangement of multiple nozzles in an X-Y plane.

FIG. 2 is a view showing an example arrangement of the nozzles N on the X-Y plane.

As shown in FIG. 2, for example, the inkjet head 1 has multiple nozzle rows arranged in the X direction, each of the nozzle rows including multiple nozzles N arranged in the Y direction.

In FIG. 2, signs are assigned to the nozzles N in the leftmost nozzle row in multiple nozzles N, and signs for the other nozzles N are omitted.

Figure 3:
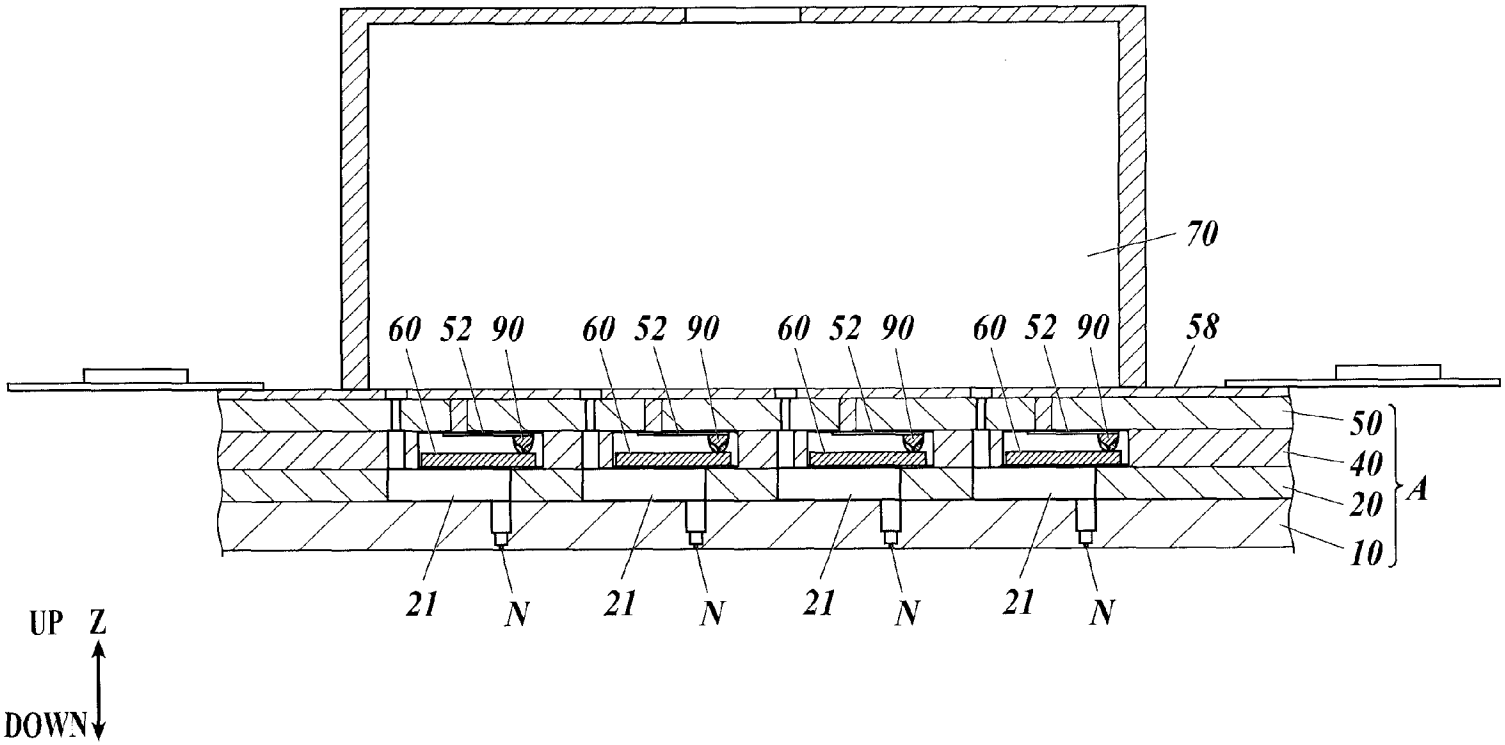
FIG. 3 is a cross-sectional view of the inkjet head.

FIG. 3 is a cross-sectional view of the inkjet head 1. FIG. 3 shows only four of the multiple nozzles N for the sake of simplicity.

As shown in FIG. 3, the nozzles N are formed in a nozzle substrate 10.

Several substrates etc. are stacked in the Z direction on the opposite side of the nozzle substrate 10 from where ink is ejected from the nozzles N. Specifically, for example, a pressure-chamber substrate 20, a diaphragm 30, a spacer substrate 40, and a wiring substrate 50 are stacked in order of distance from the nozzle substrate 10.

The structure composed of a stack of the nozzle substrate 10, the pressure-chamber substrate 20, the diaphragm 30, the spacer substrate 40, and the wiring substrate 50 is hereinafter referred to as a stack A for the sake of simplicity. Of the directions along the Z direction, a predetermined direction where ink is ejected is referred to as downward, and the direction opposite to downward is referred to as upward, relative to the nozzle substrate 10.

Figure 4:
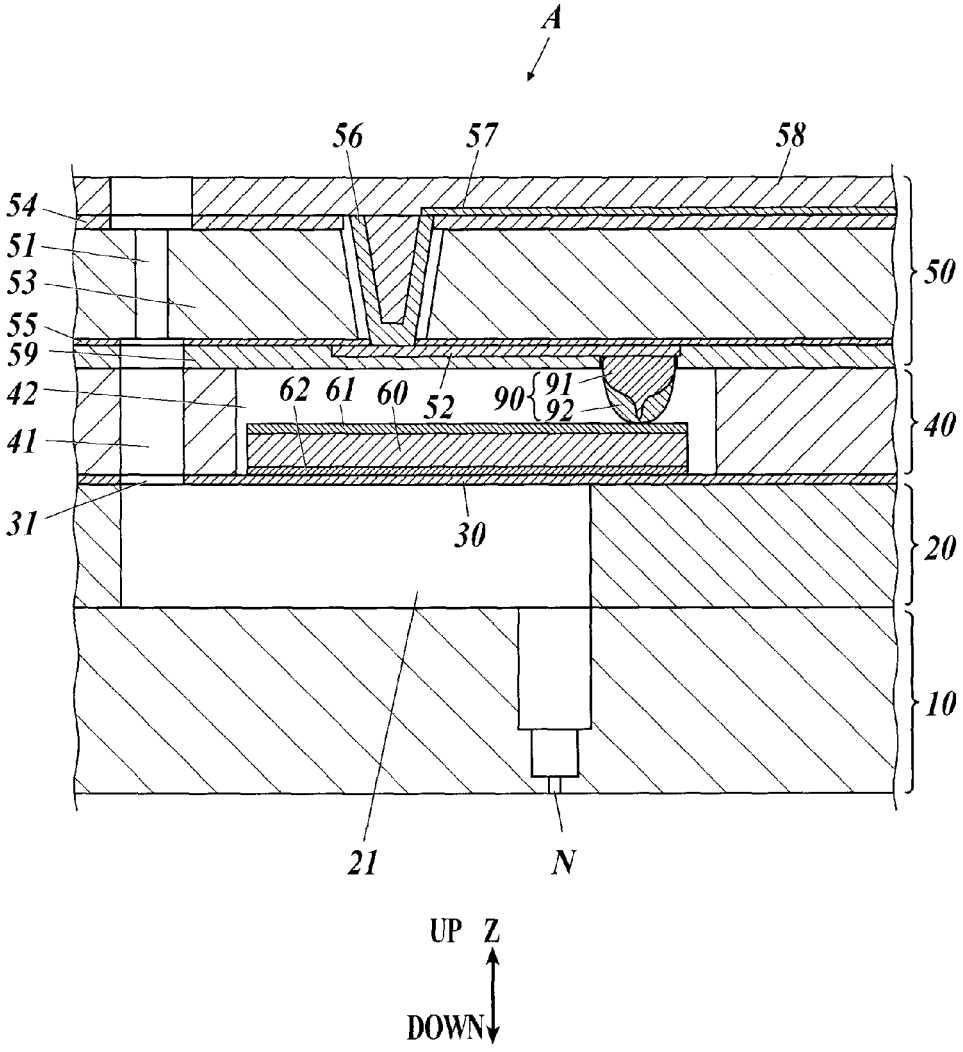
FIG. 4 is an enlarged view of the configuration related to one nozzle shown in the cross-sectional view of FIG. 3.

FIG. 4 is an enlarged view of the configuration related to one nozzle N shown in the cross-sectional view of FIG. 3.

As shown in FIGS. 3 and 4, in the pressure-chamber substrate 20, pressure chambers 21 communicating with respective nozzles N are formed.

The diaphragm 30 is disposed over the pressure chambers 21 and forms one surface (upper surface) of each of the pressure chambers 21. That is, the diaphragm 30 is disposed on, of each pressure chamber 21, a side (upward) opposite from the predetermined direction (downward) where ink is ejected. Actuators 60 are disposed on the upper surface of the diaphragm 30. The actuators 60 are in contact with the diaphragm 30.

The diaphragm 30, the spacer substrate 40, and the wiring substrate 50 include connection paths 31, 41, and 51, respectively, that communicate with pressure chambers 21. The ink flow paths formed of the connection paths 31, 41, and 51 connect the pressure chambers 21 to a common flow path 70 disposed over the wiring substrate 50.

The common flow path 70 is disposed in, for example, a case 80 upright over the wiring substrate 50 and is connected to an ink supply mechanism (not shown). The ink from the ink supply mechanism is supplied through the common flow path 70 and the connection paths 51, 41, and 31 to the pressure chambers 21. The ink supplied to the pressure chambers 21 is ejected from the nozzles N in response to pressures applied to the ink in the pressure chambers 21 by vibration of the diaphragm 30 caused by the actuators 60.

The common flow path 70 functions as a supply section to supply ink to the pressure chambers 21. The ink to be ejected from the nozzles N is contained in the pressure chambers 21. The actuators 60 apply pressures to the pressure chambers 21 to eject ink from the nozzles N.

In the following description, of the stack A, a structure constituted of the nozzle substrate 10 having the nozzles N, the pressure-chamber substrate 20 having the pressure chambers 21, the diaphragm 30 forming the upper surface of each pressure chamber 21, and the actuators 60 is referred to as a head substrate unit B. In the wiring substrate 50, ink connection paths (connection paths 51) are formed. The connection paths 51 are disposed between the supply section (common flow path 70) to supply ink to the pressure chambers 21 and the head substrate unit B, in such a way that the supply section communicates with the pressure chambers 21 through the connection paths 51.

Each of the actuators 60 is electrically connected to a wire 52 disposed on the wiring substrate 50.

Specifically, for example, each of the actuators 60 is a square piezoelectric element having upper and lower surfaces along the X-Y plane. The actuator 60 has a first electrode 61 on its upper surface and has a second electrode 62 on its lower surface.

As shown in FIG. 4, the first electrode 61 is electrically connected to the wire 52 disposed on the lower surface side of the wiring substrate 50 through a connection part 90. The connection part 90 is disposed along the Z direction in such a way as to connect the first electrode 61 to the wire 52.

The connection part 90 includes a bump 91 disposed on the wiring substrate 50.

Specifically, the bump 91 is formed by wire bonding with gold as material. The bump 91 is formed on, for example, the lower surface of the wire 52. The wire 52 is, for example, made of a conductive metal (e.g. aluminum) sheet, at least the lower surface of which is flat.

Conductive material 92 is applied to the lower end part of the bump 91. Specifically, the conductive material 92 is, for example, conductive glue. The conductive glue refers to glue containing conductive metal powder (e.g. silver powder) and having conductive properties.

In this way, the connection part 90 allows electrical connection between the wiring substrate 50 and the actuator 60 through the bump 91, which is disposed on the wiring substrate 50, and through the conductive material 92, which is applied to the bump 91.

Figure 5A:
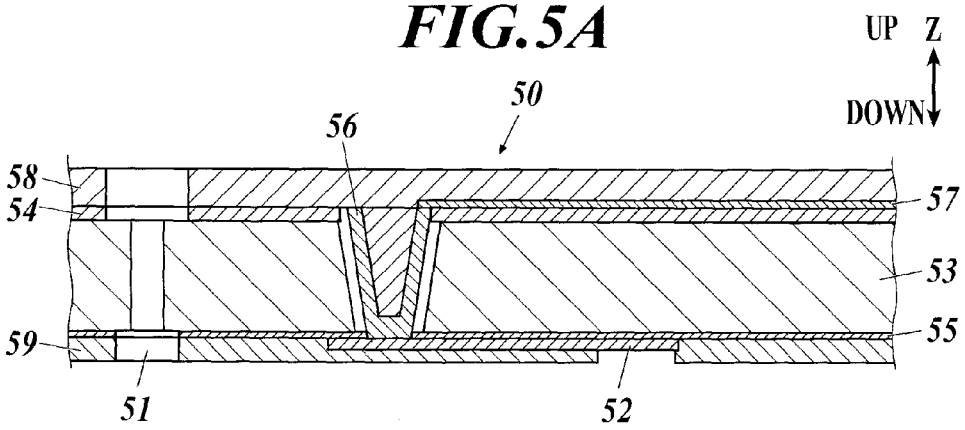
FIG. 5A is a view showing a wiring substrate before bumps are formed in processes for formation of connection parts.
Figure 5B:
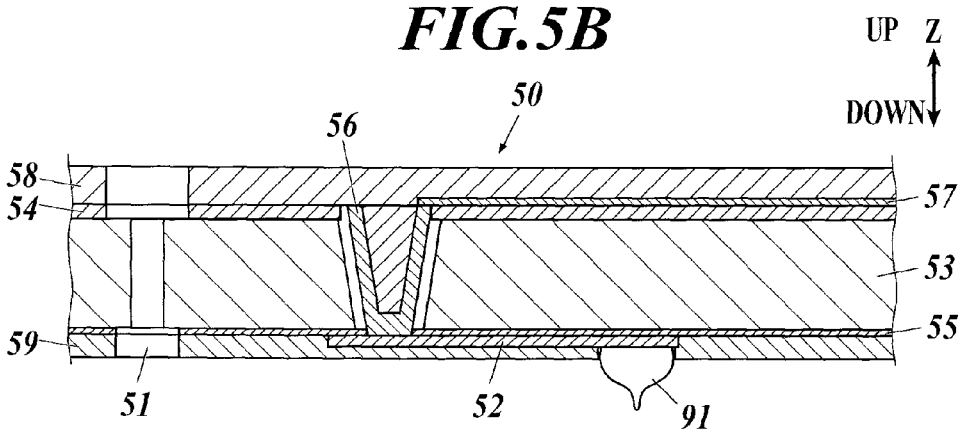
FIG. 5B is a view showing the wiring substrate after the bumps are formed and before conductive material is applied in the processes for formation of the connection parts.
Figure 5C:
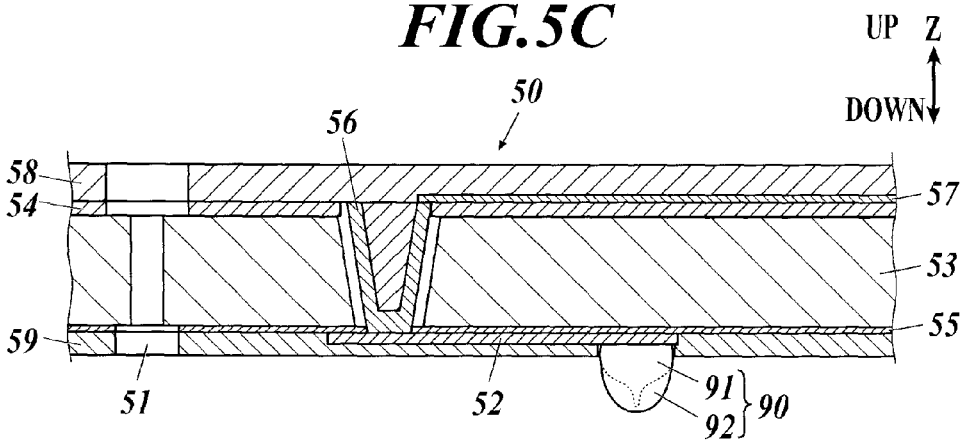
FIG. 5C is a view showing the wiring substrate after the conductive material is applied in the processes for formation of the connection parts.

FIGS. 5A to 5C are views showing the processes of forming the connection part 90.

First, the wiring substrate 50 alone is prepared as shown in FIG. 5A. That is, the spacer substrate 40 and the substrates to be disposed below the spacer substrate 40 of the stack A have not been bonded to the wiring substrate 50.

The bump 91 is then formed by wire bonding with gold as material as shown in FIG. 5B.

The conductive material 92 is then applied to the lower end part of the bump 91 by an applicator (not shown), as shown in FIG. 5C.

FIGS. 5A to 5C shows formation of one connection part 90. Actually, however, formation of the bumps 91 and application of the conductive material 92 can be carried out all together for the lower surfaces of multiple wires 52 for the respective nozzles N included in the inkjet head 1.

The wiring substrate 50 includes, for example, a plate-like interposer 53 as a base of the wiring substrate 50; insulating layers 54 and 55 covering the upper and lower surfaces, respectively, of the interposer 53; penetration electrodes 56 disposed in through-holes penetrating the insulating layer 54, the interposer 53, and the insulating layer 55; wires 57 disposed on the upper surface of the insulating layer 54 and electrically connected to the upper ends of the penetration electrodes 56; an insulating layer 58 covering the upper surfaces of the wires 57 and covering the upper surfaces of areas, on which the wires 57 are not formed, of the insulating layer 54; wires 52 disposed on the lower surface of the insulating layer 55 and electrically connected to the lower ends of the penetration electrodes 56; an insulating layer 59 covering the lower surfaces of areas, on which the bumps 91 are not formed, of the wires 52 and covering the lower surfaces of areas, on which the wires 52 are not formed, of the insulating layer 55; and the connection paths 51 passing through the insulating layer 58, the insulating layer 54, the interposer 53, the insulating layer 55, and the insulating layer 59.

The wires 52 are connected to a controller (not shown) through the penetration electrodes 56 and the wires 57, the controller being related to voltage application to the actuators 60.

The second electrodes 62 are in contact with the diaphragm 30. The diaphragm 30 is an electric conductor and functions as an electrode electrically connecting the second electrodes 62 to the controller. Specifically, the second electrodes 62 are connected to the controller through, for example, the diaphragm 30 and not-shown wires connected to the diaphragm 30.

The first electrodes 61 are connected to the controller through the connection parts 90, the wires 52, the penetration electrodes 56, and the wires 57. The second electrodes 62 are connected to the controller through the diaphragm 30 and the not-shown wires. The piezoelectric elements thus work as actuators 60 under the control of the controller.

The spacer substrate 40 creates a space between the diaphragm 30 and the wiring substrate 50. The space corresponds to the dimension of each actuator 60 and the dimension of each connection part 90 in the Z direction.

Specifically, the spacer substrate 40 has openings 42 corresponding to the positions of the actuators 60 on the upper surface of the diaphragm 30. The openings 42 pass through the spacer substrate 40 in the Z direction.

Figure 6A:
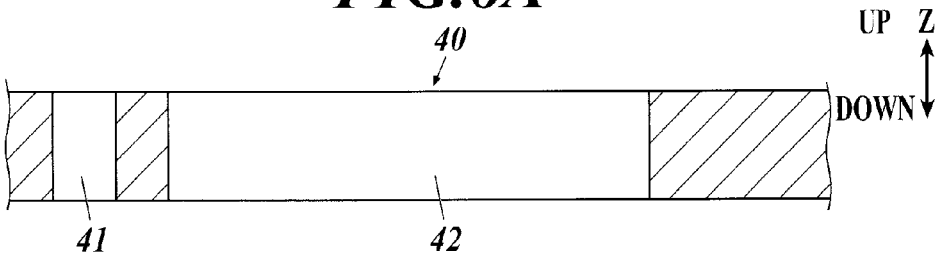
FIG. 6A is a view showing a spacer substrate in example bonding of a diaphragm and the spacer substrate.
Figure 6B:
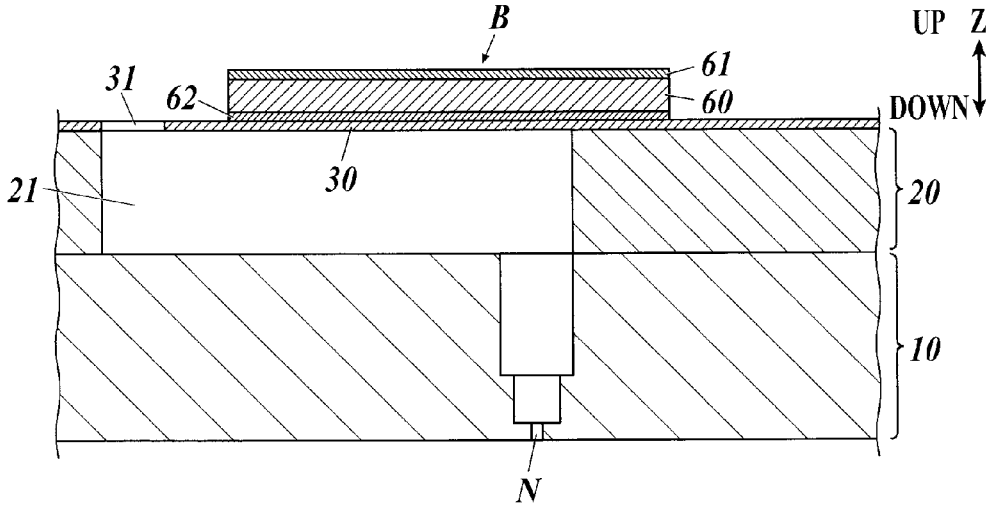
FIG. 6B is a view showing a head substrate unit in the example bonding of the diaphragm and the spacer substrate.
Figure 6C:
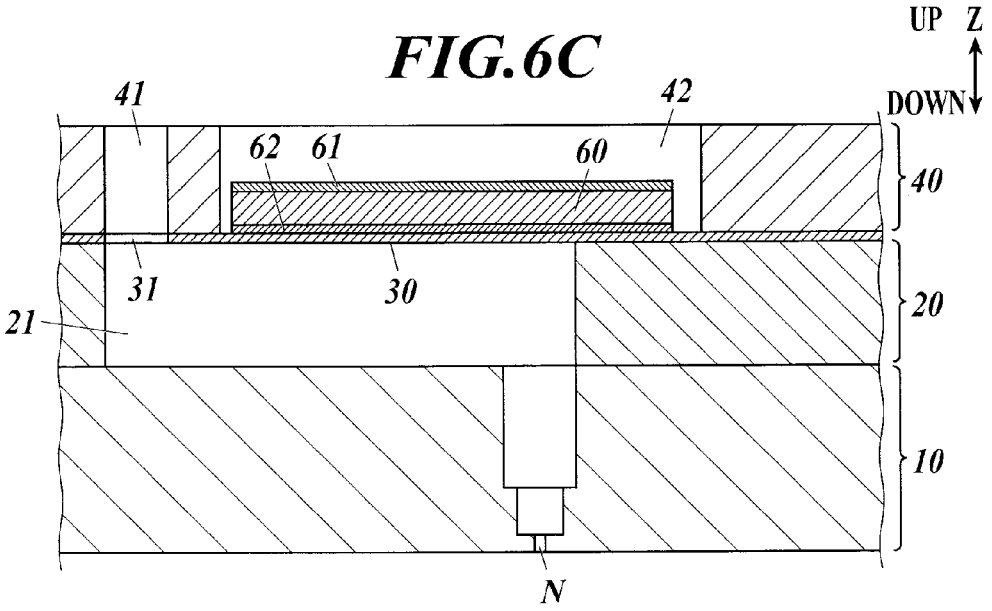
FIG. 6C is a view showing an assembly of the head substrate unit and the spacer substrate in the example bonding of the diaphragm and the spacer substrate.

FIGS. 6A to 6C are explanatory drawings related to example bonding of the diaphragm 30 and the spacer substrate 40.

The spacer substrate 40 is prepared as shown in FIG. 6A, and the head substrate unit B is prepared as shown in FIG. 6B. The diaphragm 30 has actuators 60 on its upper surface.

As shown in FIG. 6C, the spacer substrate 40 and the diaphragm 30 are bonded to each other in such a way that the actuators 60 are disposed in the openings 42 of the spacer substrate 40. An assembly of the head substrate unit B and the spacer substrate 40 is thus formed.

Then, the assembly of the head substrate unit B and the spacer substrate 40 as shown in FIG. 6C and the wiring substrate 50 with the connection parts 90 formed thereon as shown in FIG. 5A are bonded to each other with heat. The stack A is thus formed, and the actuators 60 are electrically connected to the wires 52 of the wiring substrate 50 through the connection parts 90.

The spacer substrate 40 has a thickness corresponding to the dimension of each actuator 60 and the dimension of each connection part 90 in the Z direction. Specifically, the thickness of the spacer substrate 40 corresponds to the sum of the dimension of the actuator 60 in the Z direction and the dimension of the connection part 90 in the Z direction. More specifically, the thickness of the spacer substrate 40 is, for example, not less than 50 [μm] and not more than 200 [μm]. The spacer substrate 40 having such a small thickness can minimize the degree of thermal expansion of the spacer substrate 40 and thus can surely prevent problems which would be caused by warps of the substrates and/or separation between the substrates due to the differences in coefficients of thermal expansion between the substrates.

The thickness of the spacer substrate 40 affects the length of each connection path 41 between the common flow path 70 and the pressure chamber 21. As the connection path 41 is shorter, the flow path resistance to ink flowing in the connection path 41 is smaller. Hence, reduction in dimension of each actuator 60 and the dimension of each connection part 90 in the Z direction enables reduction in thickness of the spacer substrate 40 and thus enables reduction in flow path resistance to ink.

The spacer substrate 40 has a structure (glue guard) to prevent a glue, with which the spacer substrate 40 and the wiring substrate 50 are bonded to each other, from getting into the openings 42; and a structure (air escape) to escape air.

Figure 7A:
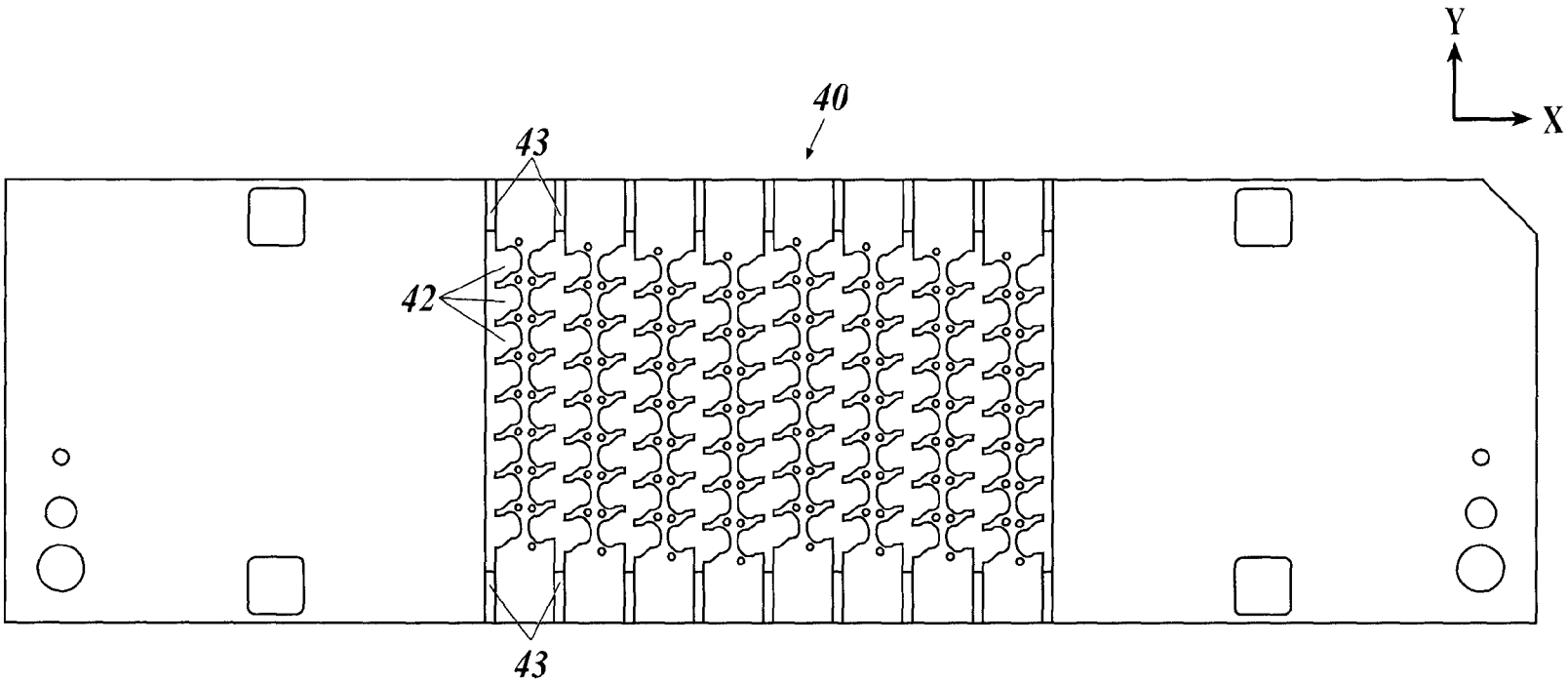
FIG. 7A is a plan view of the spacer substrate viewed from above before being bonded to the head substrate unit.
Figure 7B:
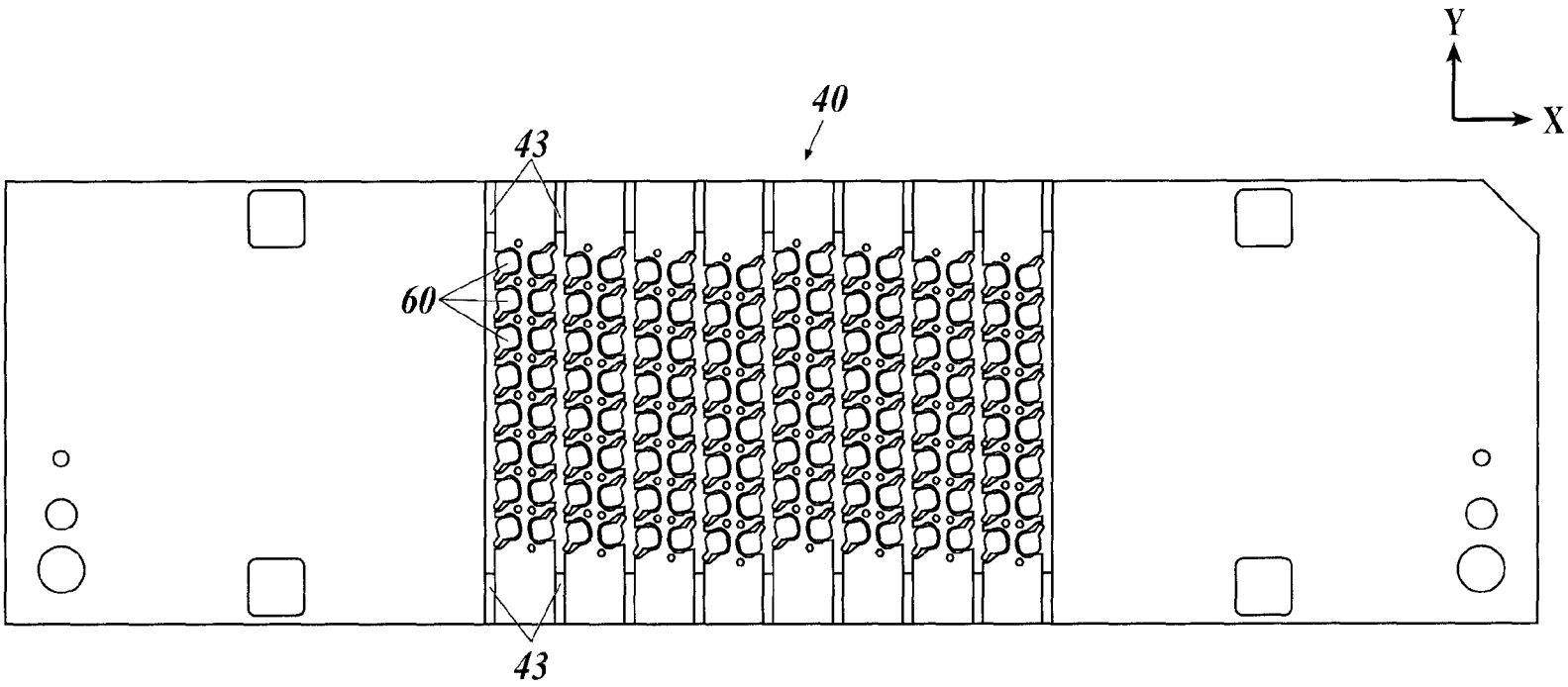
FIG. 7B is a plan view of the spacer substrate viewed from above after being bonded to the head substrate unit.

Specifically, for example, as shown in FIGS. 7A and 7B, the spacer substrate 40 has linear patterns 43 extending in the Y direction and disposed at both ends of each row of openings 42 extending in the Y direction. The patterns 43 function as the glue guard and the air escape.

More specifically, a photolithography process is performed on both surfaces of the spacer substrate 40 to form the openings 42. The patterns 43 are formed on only one surface (upper surface) to form linear counterbores on this surface.

As shown in FIGS. 7A and 7B, adjacent openings 42 in the Y direction of multiple openings 42 forming each row are continuous with each other. The patterns 43 are formed to be continuous with the openings 42 at the both ends of each row. When an assembly of the head substrate unit B and the spacer substrate 40 as shown in FIG. 6C and the wiring substrate 50 with the connection parts 90 formed thereon as shown in FIG. 5A are bonded to each other with heat, the air in the openings 42 increasing in volume by the heat can be escaped from the patterns 43. That is, the patterns 43 function as the air escape. Glue, with which the spacer substrate 40 and the wiring substrate 50 are bonded to each other, is to be in contact with the frame part of the upper plate surface of the spacer substrate 40 shown in FIG. 7B. If there is a surplus of glue, the surplus glue moves along the upper plate surface for space. The patterns 43 allow the surplus glue to get into the patterns 43 and thus prevent the glue from getting into the openings 42. That is, the patterns 43 functions as the glue guard.

In FIG. 7, signs are assigned to the leftmost four openings 42, patterns 43, and actuators 60 among multiple openings 42, patterns 43, and actuators 60, and signs for the rest having the same structures are omitted.

The differences in coefficients of thermal expansion between the pressure-chamber substrate 20, the diaphragm 30, the wiring substrate 50, and the spacer substrate 40 are equal to or less than a predetermined value. The phrase "the differences in coefficients of thermal expansion are equal to or less than a predetermined value" means that the differences in coefficients of thermal expansion between the pressure-chamber substrate 20, the diaphragm 30, the wiring substrate 50, and the spacer substrate 40 are within such a range that does not cause problems that would be produced by warps of the substrates.

Specifically, the material for the pressure-chamber substrate 20, the diaphragm 30, and the wiring substrate 50 is silicon (Si); and the material for the spacer substrate 40 is 42 alloy.

More specifically, the whole of each of the pressure-chamber substrate 20 and the diaphragm 30 is made of silicon. The interposer 53 of the wiring substrate 50 is made of silicon. The wiring substrate 50 has substantially the same coefficient of thermal expansion as the pressure-chamber substrate 20 and the diaphragm 30 because the interposer 53, which forms a major part of the wiring substrate 50, is made of silicon.

The material for the spacer substrate 40, 42 alloy, is an alloy composed of nickel accounting for 42 percent by weight, iron accounting for 57 percent by weight, and a trace of added material (e.g. copper and manganese) accounting for the rest.

The coefficient of thermal expansion of silicon is $2.5\times10^{-6}$ [1/° C.] to $4.0\times10^{-6}$[1/° C.]. The coefficient of thermal expansion of 42 alloy is $4.5\times10^{-6}$ [1/° C.] to $6.0\times10^{-6}$ [1/° C.]. The coefficients of thermal expansion of both silicon and 42 alloy are very small. The difference in coefficient of thermal expansion between silicon and 42 alloy is $0.5\times10^{-6}$ [1/° C.] to $3.5\times10^{-6}$ [1/° C.]. That is, the difference in coefficient of thermal expansion between silicon and 42 alloy is equal to or less than $3.5\times10^{-6}$ [1/° C.]. The predetermined value is therefore $3.5\times10^{-6}$ [1/° C.]. The coefficients of thermal expansion of silicon and 42 alloy are thus substantially the same. Even when temperature changes are produced in the substrates due to various factors, such as heat applied to the substrates for formation of the stack A and heat generation caused by the operation of the inkjet head 1, the substrates having very small degrees of thermal expansion that are substantially the same can prevent problems which would be caused by warps of the substrates and/or separation between the substrates due to the differences in coefficients of thermal expansion between the substrates. Specifically, changes in angles at which ink is ejected from the nozzles N that would be caused by warps of the substrates are prevented. Further, ink leakages from the parts where the substrates are separated from each other are prevented. The inkjet head 1 according to the present embodiment thus has enhanced reliability.

The materials for the pressure-chamber substrate 20, the diaphragm 30, the wiring substrate 50, and the spacer substrate 40 are determined within a range that does not cause electrical disconnections in the inkjet head 1 (e.g. disconnections at the connection parts 90) due to separation between the substrates caused by warps of the substrates which would be caused by the differences in coefficients of thermal expansion.

As an example, if the spacer substrate 40 has a thickness of 200 [μm], which is the maximum thickness assumed in the present embodiment, and if the inkjet head 1 is heated from an ordinary temperature (e.g. about 25[° C.]) to 80 [° C.], the degree of separation between the substrates being 0.16 [μm] or less is acceptable. In order to achieve such a degree of separation, the materials for the substrates are required to have coefficients of thermal expansion equal to or less than $10\times10^{-6}$ [1/° C.].

The above conditions are for the case in which the spacer substrate 40 has the maximum thickness assumed in the present embodiment (i.e., 200 [μm]). A thinner spacer substrate 40 would naturally have a smaller degree of thermal expansion and thus would relax the upper limit of the coefficients of thermal expansion. The coefficients of thermal expansion required of materials could be changed as appropriate depending on the configuration, but $10\times10^{-6}$[1/° C.] or less would be assumed to be acceptable. Silicon and 42 alloy both have coefficients of thermal expansion below $10\times10^{-6}$[1/° C.].

The material for the nozzle substrate 10 is silicon.

The nozzle substrate 10, which is made of silicon, has substantially the same coefficient of thermal expansion as the pressure-chamber substrate 20, the diaphragm 30, the wiring substrate 50, and the spacer substrate 40. This prevents problems due to warps which would be caused by differences in coefficients of thermal expansion between the nozzle substrate 10 and the other substrates, such as leakages of ink from gaps due to separation between the nozzle substrate 10 and the pressure-chamber substrate 20.

The nozzles N are formed by, for example, dry etching on the nozzle substrate 10.

The dry etching enables formation of the nozzles N with a highly accurate diameter at highly accurate positions. That is, the amount of ink to be ejected from each nozzle N and the ejection positions can be adjusted with high accuracy. This makes it possible to provide an inkjet head 1 that can perform ink ejection with enhanced accuracy.

The pressure-chamber substrate 20, the diaphragm 30, the wiring substrate 50, and the spacer substrate 40 are each made of material having a thermal conductivity of equal to or more than 10 [$W \cdot m^{-1} \cdot K^{-1}$].

Specifically, silicon, which is the material for the pressure-chamber substrate 20, the diaphragm 30, and the wiring substrate 50, has a thermal conductivity of 168 [$W \cdot m^{-1} \cdot K^{-1}$]; and 42 alloy, which is the material for the spacer substrate 40, has a thermal conductivity of 15 [$W \cdot m^{-1} \cdot K^{-1}$].

Since the pressure-chamber substrate 20, the diaphragm 30, the wiring substrate 50, and the spacer substrate 40 are each made of material having a thermal conductivity of equal to or more than 10 [$W \cdot m^{-1} \cdot K^{-1}$], uniformity in temperature is achieved in the temperature distribution, especially in the temperature distribution in the planar direction, in the stack A. This achieves uniformity in temperature of the multiple nozzles N and thus allows the temperature conditions of the nozzles N to be substantially the same. In the inkjet head 1, the heat quantities generated at the nozzles N vary depending on the ejection rates of the nozzles N. However, the stack A made of materials having thermal conductivities of equal to or more than 10 [$W \cdot m^{-1} \cdot K^{-1}$] allows good heat transfers among the nozzles N, leading to uniformity in temperature of the nozzles N, regardless of the ejection rates of the nozzles N. This reduces variation in ink ejection characteristics which would be caused by the differences in temperatures of the nozzles N and thus achieves highly accurate ink ejection.

The spacer substrate 40 is surface-treated.

Specifically, for example, the spacer substrate 40 is subjected to nickel (Ni) plating as the surface treatment. The spacer substrate 40 is subjected to the surface treatment after the spacer substrate 40 is processed for formation of the connection paths 41 and the openings 42 etc.

The surface treatment allows the spacer substrate 40 to have antirust properties and resistance to solvents and thus improves durability of the spacer substrate 40. In particular, since the spacer substrate 40 has the connection paths 41, the surface treatment effectively works to produce resistance to solvents contained in inks.

The surface treatment is not limited to nickel (Ni) plating but may be any other surface treatment that can produce antirust properties and resistance to solvents. Other concrete examples of surface treatments include a process for forming a film of ethyl silicate, such as tetraethyl orthosilicate (TEOS); and a process for forming a film of paraxylylene polymer, such as Parylene (registered trademark), on the surfaces of the spacer substrate 40. As a concrete process for forming such films, vapor deposition, such as sputtering, may be used. The description related to the surface treatment is not limitative but is illustrative only.

According to the inkjet head 1 of the present embodiment, the differences in coefficients of thermal expansion between the pressure-chamber substrate 20, the diaphragm 30, the wiring substrate 50, and the spacer substrate 40 are equal to or less than a predetermined value. This prevents problems which would be caused by warps of the substrates and/or separation between the substrates due to the differences in coefficients of thermal expansion between the substrates, such as changes in angles at which ink is ejected from the nozzles N which would be caused by warps of the substrates, and ink leakages from the parts where the substrates are separated from each other.

Further, since the pressure-chamber substrate 20, the diaphragm 30, the wiring substrate 50, and the spacer substrate 40 are each made of material having a thermal conductivity of equal to or more than 10 [$W \cdot m^{-1} \cdot K^{-1}$], uniformity in temperature is achieved in the temperature distribution of each of the substrates constituting the inkjet head 1, especially in the temperature distribution in the planar direction. This achieves uniformity in temperature of the multiple nozzles N and thus makes the temperature conditions of the nozzles N substantially the same. This reduces variation in ink ejection characteristics which would be caused by the differences in temperature of the nozzles N and thus achieves highly accurate ink ejection.

Further, the material for the pressure-chamber substrate 20, the diaphragm 30, and the wiring substrate 50 is silicon; and the material for the spacer substrate 40 is alloy of iron and 42 [%] nickel. Thus, generally available materials can be used to manufacture the inkjet head 1 having high reliability and capable of preventing problems which would be caused by warps of the substrates and/or separation between the substrates due to the differences in coefficients of thermal expansion between the substrates.

Further, the spacer substrate 40 has a thickness of not less than 50 [μm] and not more than 200 [μm]. Such thinness of the spacer substrate 40 can minimize the degree of thermal expansion of the spacer substrate 40 and thus can surely prevent problems which would be caused by warps of the substrates and/or separation between the substrates due to the differences in coefficients of thermal expansion between the substrates.

Further, in the case in which the spacer substrate 40 has connection paths 41 as in the present embodiment, the thinness of the spacer substrate 40 allows the connection paths 41 to be short and thus can reduce the flow path resistance to ink.

Further, the surface treatment performed on the spacer substrate 40 produces antirust properties and resistance to solvents, enhancing the durability of the spacer substrate 40.

Further, the material for the nozzle substrate 10 being silicon prevents problems due to warps which would be caused by the differences in coefficients of thermal expansion between the nozzle substrate 10 and the other substrates.

Further, since the nozzles N are formed by dry etching on the nozzle substrate 10, the nozzles N can be formed with a highly accurate diameter at highly accurate positions. That is, the amount of ink to be ejected from each nozzle N and the ejection positions can be adjusted with high accuracy. This makes it possible to provide an inkjet head 1 that can perform ink ejection with enhanced accuracy.

Further, since the bumps 91 are formed on the wiring substrate 50, the actuators 60 are not subject to damage due to heat and vibrations caused by formation of the bumps 91. This enhances the rate of yield of the inkjet heads 1 in manufacturing the inkjet heads 1.

Further, in the case in which the actuators 60 are piezoelectric elements as in the present embodiment, there might be a problem of bad contacts between the bumps 91 and the first electrodes 61 if the bumps 91 are formed on the piezoelectric elements, which have rough surfaces. In the inkjet head 1 according to the present embodiment, in contrast, the bumps 91 are formed on the lower surfaces of the wires 52, which lower surfaces are flat. Accordingly, good contacts between the bumps 91 and the wires 52 are achieved.

Further, the conductive material 92 applied to the bumps 91 makes connections between the bumps 91 and the actuators 60. The bumps 91 and the conductive material 92 thus can make good connections between the actuators 60 and the wiring substrate 50.

Further, the conductive material 92, which is conductive glue, can be easily applied to the bumps 91 and can be easily bonded to the actuators 60. The conductive material 92 thus facilitates the processes related to the manufacture of the inkjet head 1 including making connections between the actuators 60 and the wiring substrate 50.

The embodiment of the present invention disclosed here should be construed as illustrative in all respects and not as limitative. The scope of the present invention is shown not by the description set forth above but by the claims and is to include all the modifications within the meaning and scope equivalent to the claims.

For example, in the foregoing embodiment, conductive glue is used as the conductive material 92, but this is illustrative only and is not limitative.

The conductive material 92 may be, for example, solder. Specifically, for example, cream solder may be applied to the wiring substrate 50 with the bumps 91 formed thereon as shown in FIG. 5B using a screen printer so that the solder may be used as the conductive material 92. In this case, the conductive material 92 may be applied for the multiple bumps 91 for the multiple nozzles N all together.

Alternatively, paste containing 60 [%] to 70 [%] silver may also be used as the conductive material 92.

Further, in the foregoing embodiment, silicon is used for the pressure-chamber substrate 20, the diaphragm 30, and the wiring substrate 50; and 42 alloy is used for the spacer substrate 40 as materials that satisfy the condition that the differences in coefficients of thermal expansion between the pressure-chamber substrate 20, the diaphragm 30, the spacer substrate 40, and the wiring substrate 50 are equal to or less than the predetermined value. This is, however, illustrative only and not limitative. This should never exclude the use of any other material that satisfies the condition that the differences in coefficients of thermal expansion between the pressure-chamber substrate 20, the diaphragm 30, the spacer substrate 40, and the wiring substrate 50 are equal to or less than the predetermined value now and in the future.

Further, in the foregoing embodiment, the whole of the spacer substrate 40 is surface-treated, but this is illustrative only and not limitative. The surface treatment performed at least on the connection paths 41 in the spacer substrate 40 could produce antirust properties and resistance to solvents related to contacts with inks.

Further, the configuration of the stack A in the foregoing embodiment is illustrative only and not limitative.

Figure 8:
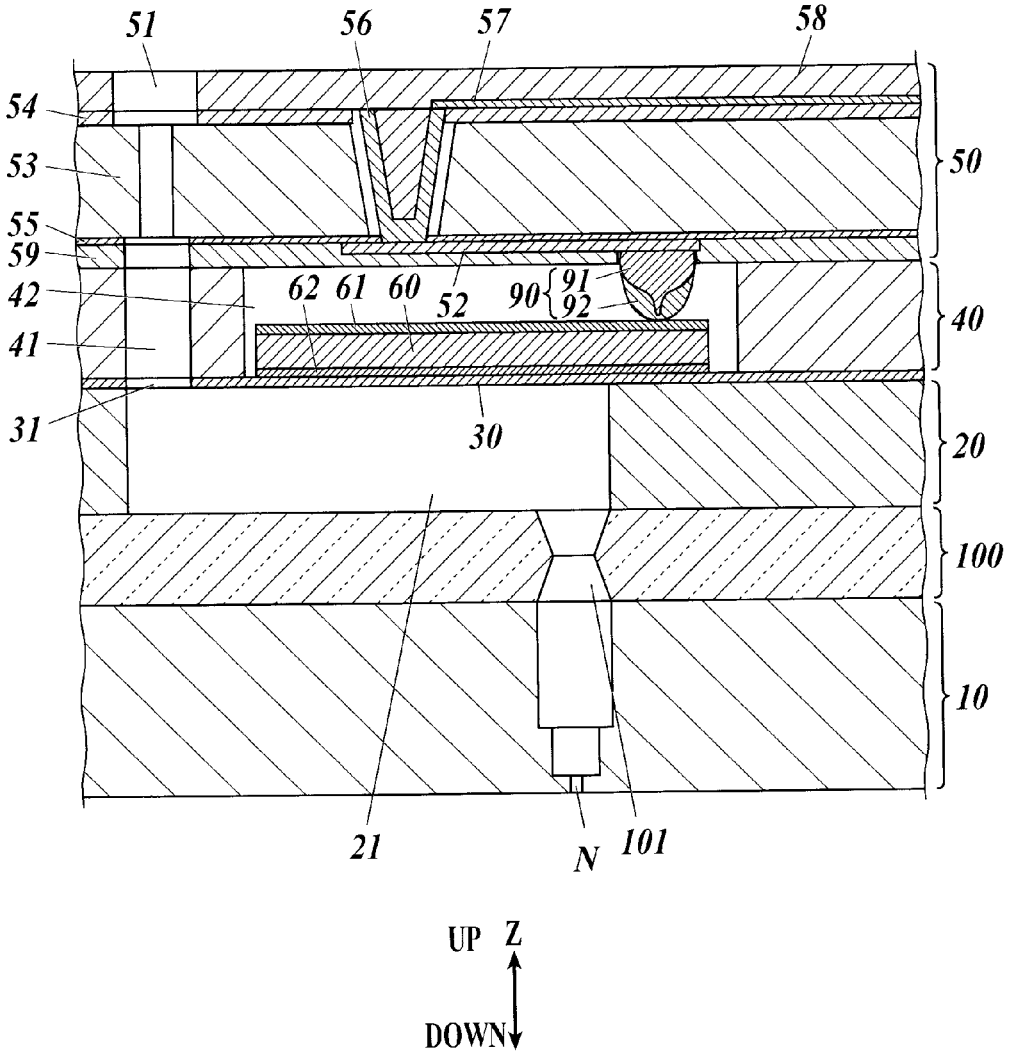
FIG. 8 is a cross-sectional view of a modified inkjet head according the present invention.
Figure 9:
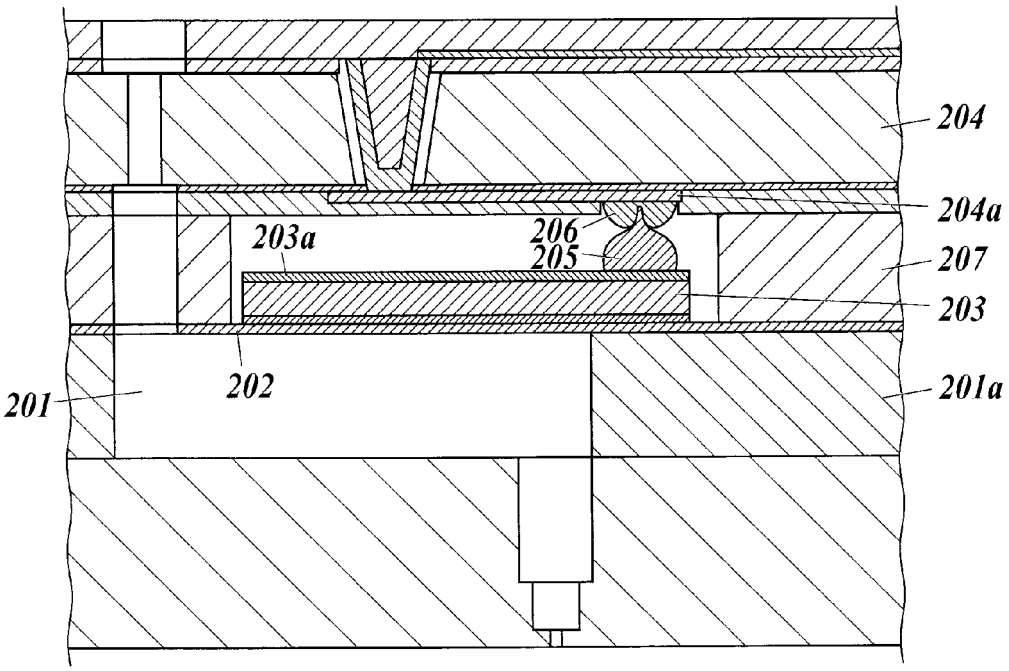
FIG. 9 is a cross-sectional view of the configuration, around a nozzle, of a conventional inkjet head.

For example, as shown in FIG. 8, an additional substrate (intermediate substrate 100) may be disposed between the nozzle substrate 10 and the pressure-chamber substrate 20. The intermediate substrate 100 is provided for the purpose of, for example, disposing connection paths 101 between the nozzle substrate 10 and the pressure-chamber substrate 20. If the connection paths 101 are provided by interposing the intermediate substrate 100 as shown in FIG. 8, the ink flow paths that lead to the nozzles N can be formed into any shape more easily, e.g., a shape having a reduced diameter. This facilitates adjustment of the shapes of the ink flow paths to adjust the kinetic energy to be applied to ink, which is related to ink ejection.

In the case shown in FIG. 8, too, the differences in coefficients of thermal expansion between the intermediate substrate 100 and the other substrates are preferably equal to or less than the predetermined value. Specifically, the intermediate substrate 100 may be made of, for example, silicon. Then, the differences in coefficients of thermal expansion between the intermediate substrate 100 and the other substrates can be equal to or less than the predetermined value.

Further, in the foregoing embodiment, the pressure-chamber substrate 20 and the diaphragm 30 are separately provided and stacked, but this is illustrative only and not limitative. For example, the pressure-chamber substrate 20 and the diaphragm 30 may be formed as a single member.

INDUSTRIAL APPLICABILITY

The present invention can be used for inkjet heads.

REFERENCE NUMERALS

1 inkjet head
10 nozzle substrate
20 pressure-chamber substrate
21 pressure chamber
30 diaphragm
40 spacer substrate
41 and 51 connection path
50 wiring substrate
52 wire
53 interposer
60 actuator
70 common flow path
90 connection part
91 bump
92 conductive material
A stack
B head substrate unit
N nozzle

The invention claimed is:

1. An inkjet head comprising:

a pressure-chamber substrate in which pressure chambers to contain ink are formed, the pressure chambers communicating with respective nozzles from which the ink is ejected in a predetermined direction;

a spacer substrate disposed on an opposite side of a diaphragm from the predetermined direction, wherein the diaphragm forms one surface of each of the pressure chambers, and the one surface is on an opposite side of the each of the pressure chambers from the predetermined direction;

a wiring substrate disposed on an opposite side of the spacer substrate from the predetermined direction; and actuators in contact with the diaphragm in a space formed by the spacer substrate between the wiring substrate and the diaphragm, the actuators being electrically connected to respective wires of the wiring substrate, wherein differences in coefficients of thermal expansion between the pressure-chamber substrate, the diaphragm, the spacer substrate, and the wiring substrate are equal to or less than a predetermined value, the spacer substrate includes ink connection paths communicating with the respective pressure chambers, and at least the ink connection paths are subjected to a surface treatment.

2. The inkjet head according to claim 1, wherein the pressure-chamber substrate, the diaphragm, the spacer substrate, and the wiring substrate are each made of material having a thermal conductivity of equal to or more than 10 [$W \cdot m^{-1} \cdot K^{-1}$].

3. The inkjet head according to claim 1, wherein material for the pressure-chamber substrate, the diaphragm, and the wiring substrate is silicon; and material for the spacer substrate is 42 alloy.

4. The inkjet head according to claim 1, wherein the spacer substrate has a thickness of not less than 50 [μm] and not more than 200 [μm].

5. The inkjet head according to claim 1, further comprising a nozzle substrate having the nozzles formed thereon, wherein material for the nozzle substrate is silicon.

6. The inkjet head according to claim 5, wherein the nozzles are formed by dry etching on the nozzle substrate.

7. The inkjet head according to claim 1, wherein the surface treatment is one of nickel (Ni) plating, a process for forming a film of ethyl silicate, and a process for forming a film of paraxylylene polymer.

8. The inkjet head according to claim 5, further comprising an intermediate substrate between the nozzle substrate and the pressure-chamber substrate, wherein the intermediate substrate includes connection paths which connect the nozzle substrate and the pressure-chamber substrate, wherein each of the connection paths has a part having a reduced diameter.

9. The inkjet head according to claim 1, wherein the nozzles are two-dimensionally arrayed.

10. The inkjet head according to claim 1, wherein the actuators are electrically connected to the respective wires of the wiring substrate through respective connection parts, wherein each of the connection parts comprises a bump.

11. The inkjet head according to claim 10, wherein the each of the connection parts comprises conductive glue applied to the bump.

* * * * *